US005715648A

United States Patent [19]

Yates

[11] Patent Number: 5,715,648

[45] Date of Patent: Feb. 10, 1998

[54] ENVELOPE OPENING APPARATUS

[75] Inventor: Keith Yates, Great Dunmow, England

[73] Assignee: Pitney Bowes Inc., Stamford, Conn.

[21] Appl. No.: 588,499

[22] Filed: Jan. 18, 1996

[51] Int. Cl.[6] ..... B65B 43/26

[52] U.S. Cl. ..... 53/381.5; 53/381.7; 53/381.1; 493/245

[58] Field of Search ..... 53/381.1, 381.3, 53/381.5, 381.7, 460, 206, 569, 284.3, 468, 492; 493/245, 453, 212, 309, 917, 255, 258, 259

[56] References Cited

U.S. PATENT DOCUMENTS

| | | | |
|---|---|---|---|
| 3,910,007 | 10/1975 | Dorer | 53/381.3 |
| 4,337,609 | 7/1982 | Foster et al. | 53/284.3 |
| 4,766,715 | 8/1988 | Dimur | 53/381.7 |
| 4,999,972 | 3/1991 | Foster | 53/381.1 |
| 5,138,816 | 8/1992 | Holbrook et al. | 53/381.7 |
| 5,168,689 | 12/1992 | Macelis | 53/381.5 |
| 5,247,780 | 9/1993 | Kulpa et al. | 53/381.5 |
| 5,255,498 | 10/1993 | Hotchkiss et al. | 53/284.3 |
| 5,414,977 | 5/1995 | Cohen | 53/381.5 |

*Primary Examiner*—James F. Coan
*Assistant Examiner*—Gene K.
*Attorney, Agent, or Firm*—Christopher Capelli; Melvin J. Scolnick; Robert Meyer

[57] ABSTRACT

Apparatus for opening an envelope having a front panel, a back panel and a closing flap. The apparatus includes: a device for supporting the envelope in a substantially horizontal plane wherein the back panel is situated above the front panel; a pair of pivotable paddles located beneath the closing flap and the front panel, each of the paddles having an interior end and an exterior end; a pair of pivotable, hold-down fingers located above and spaced from the pivotable paddles; a device for rotating the interior ends of the paddles downward; and a device for pivoting the hold-down fingers into engagement with the paddles when the ends of the paddles are rotated downward, whereby the front and back panels of the envelope is caused to separate.

6 Claims, 3 Drawing Sheets

ENVELOPE OPENING APPARATUS

BACKGROUND OF THE INVENTION

The instant invention relates to apparatus for inserting documents into envelopes, and more particularly to apparatus for "puckering" the envelope into an open position so that the documents can be inserted into the envelope.

Inserting machines typically feed and collate a plurality of enclosures and then insert the collated enclosures into a waiting envelope. Inserting machines are used with a wide range of enclosure thicknesses and with a wide variety of envelope sizes and styles. Guide fingers and other devices are well known for opening envelopes prior to insertion of enclosures. However, prior art opening devices typically require operator intervention in order to accommodate a range of enclosure thicknesses, and/or do not function reliably for a variety of envelope sizes and styles.

Thus, the instant invention provides apparatus which puckers the envelope open for insertion of enclosures and does so reliably for a wide range of enclosures and envelopes, thereby overcoming the problems associated with prior art envelope opening devices.

SUMMARY OF THE INVENTION

Accordingly, the instant invention provides apparatus for opening an envelope having a front panel, a back panel and a closing flap. The apparatus includes: a device for supporting the envelope in a substantially horizontal plane wherein the back panel is situated above the front panel; a pair of pivotable paddles located beneath the closing flap and the front panel, each of the paddles having an interior end and an exterior end; a pair of pivotable, hold-down fingers located above and spaced from the pivotable paddles; a device for rotating the interior ends of the paddles downward; and a device for pivoting the hold-down fingers into engagement with the paddles when the ends of the paddles are rotated downward, whereby the front and back panels of the envelope are caused to separate.

DETAILED DESCRIPTION OF THE PREFERRED EMBODIMENT

Figure 3:
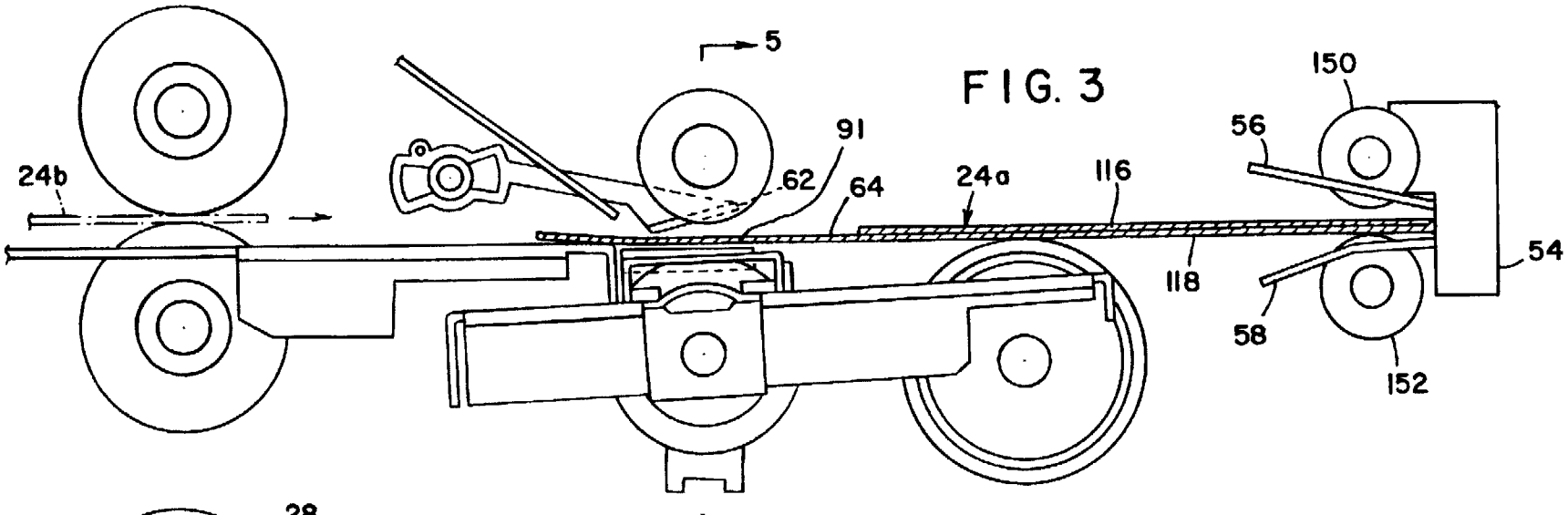
FIG. 3 is a side, elevational view of the inserting apparatus in accordance with the instant invention, showing an envelope prior to being opened for insertion.

In describing the preferred embodiment of the instant invention, reference is made to the drawings, wherein there is seen FIG. 3 an inserting station generally designated 20 for inserting paper documents (not shown) into a waiting envelope **24*a*. The inserting station 20 includes a supporting deck 26 and a pair of envelope feed rollers 28 and 30 for feeding an envelope 24*b* to the position occupied by the envelope 24*a*. Downstream of the rollers 28 and 30 are a fixed, upper, drive shaft 32 and a vertically translatable, lower, shaft 34. The upper shaft 32 supports four, spaced, continuously rotating feed rollers 36, 38, 40 and 42 rotatably secured thereto (see FIGS. 5 & 6) while the lower shaft 34 supports four spaced, cooperating rollers 44, 46 48 and 50 respectively fixedly secured to the shaft 34**.

Downstream of the shafts 32 and 34 is a bending roll 52 and further downstream is a vertically translatable envelope stop 54. An upper guide 56 and a lower guide 58 provide a path toward the stop 54 for the envelope **24*a***.

Figure 1:
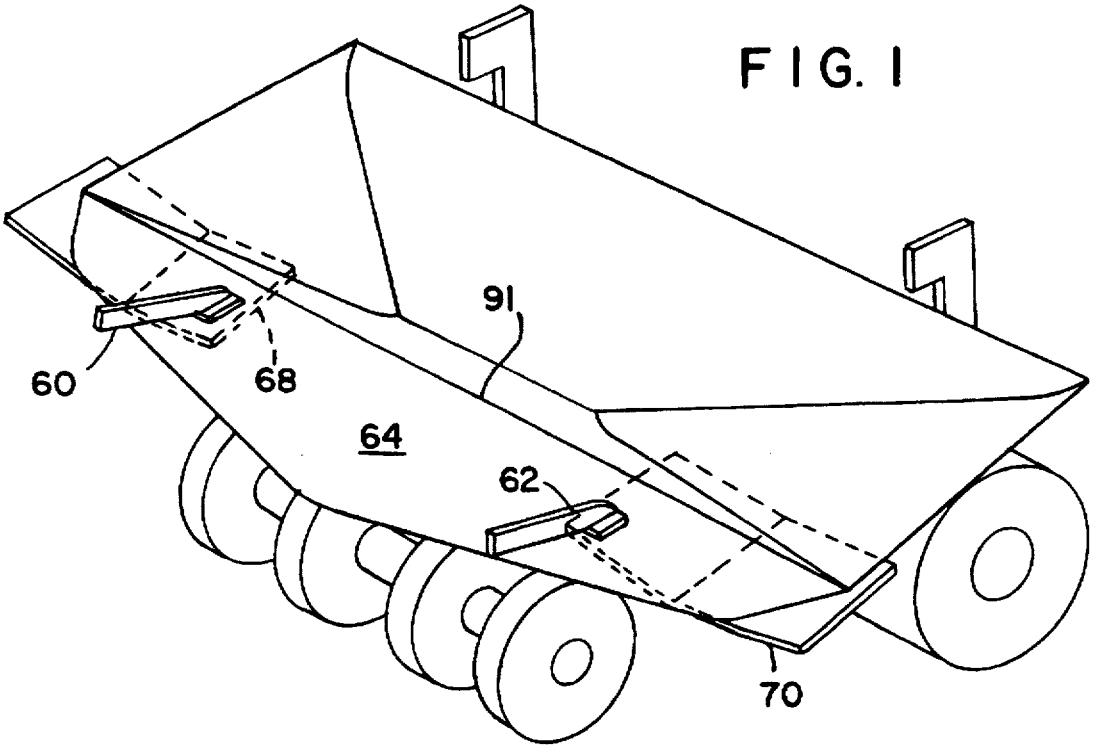
FIG. 1 is a perspective view of envelope opening apparatus in accordance with the instant invention.
Figure 2:
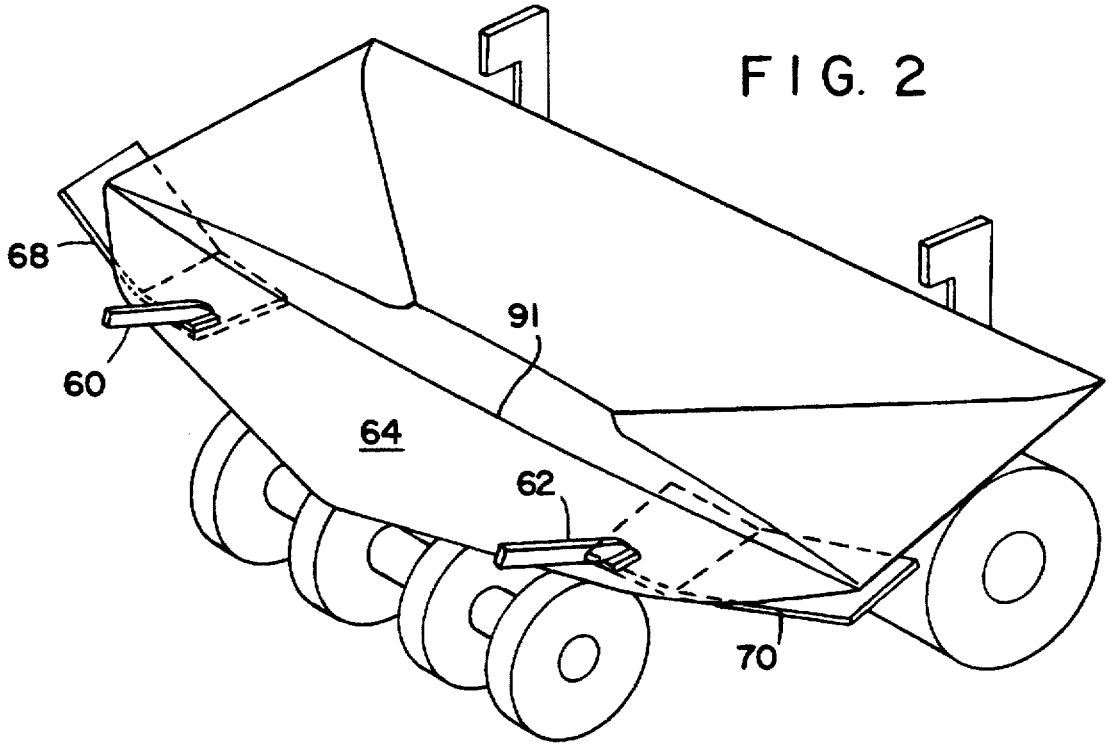
FIG. 2 is similar to FIG. 1 but shows the envelope puckered open.

A pair of pivotable, hold-down fingers 60 and 62 (see FIGS. 1 and 2) are situated between the shafts 32 and 34 and function, as explained in further detail hereinbelow, to hold the envelope closing flap 64 against a pair of flapper paddles 68 and 70 respectfully which cooperate with the fingers 60 and 62 respectively to open the envelope **24*a* as explained in further detail hereinbelow. The flapper paddles 68 and 70 (see FIGS. 5 & 6) each consist of an interior leg 104 and 106 respectively and an exterior, angled leg 108 and 110 respectively. The angled legs 108 and 110 form obtuse angles of between about 135 to 165 degrees with the legs 104 and 108 respectively. Each paddle 68 and 70 is pivotable about a support 112 and 114 respectively, which supports are located slightly inside the outside edges of the envelope and under the envelope flap 64. The paddles 68 and 70 are located beneath and on either side of the hinge 91 of the envelope 24*a***.

The paper documents which are to be inserted into the waiting envelope **24*a* are fed by feed apparatus (not shown), such as folding rollers, along a chute 72 through the opening between the upper rollers 36, 38, 40 and 42 and the lower rollers 44, 46, 48 and 50. The momentum given the documents by the feed apparatus conveys the documents into the waiting envelope 24*a***.

The operation of the insertion station 20 will now be described. The envelope feed rollers 28 and 30 cooperate to feed an envelope from the position occupied by envelope **24*b* (FIG. 3) to the position occupied by envelope 24*a* against the envelope stop 54 in the down position, as shown in FIG. 3. The feed rollers 36, 38, 40 and 42 are separated from the drive rollers 44, 46, 48 and 50 respectively so that the envelope can be conveyed directly to the stop 54. The hold-down fingers 60 and 62 are in a raised position to allow the envelope to pass thereunder, and the flapper paddles 68 and 70 are in a position where their interior ends 96 and 98 respectively are raised to support the envelope flap 64** in a horizontal plane.

Figure 4:
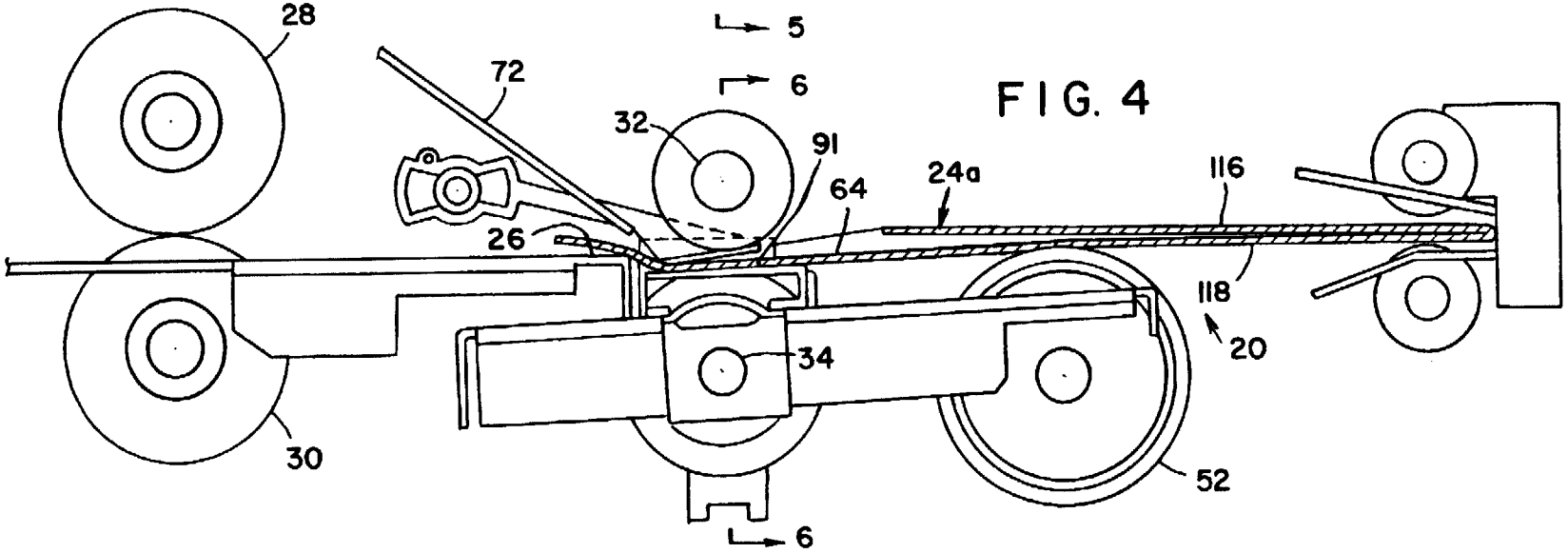
FIG. 4 is similar to FIG. 3 but shows the hold-down fingers rotated to engage the envelope flap and the back panel of the envelope slightly raised.
Figure 6:
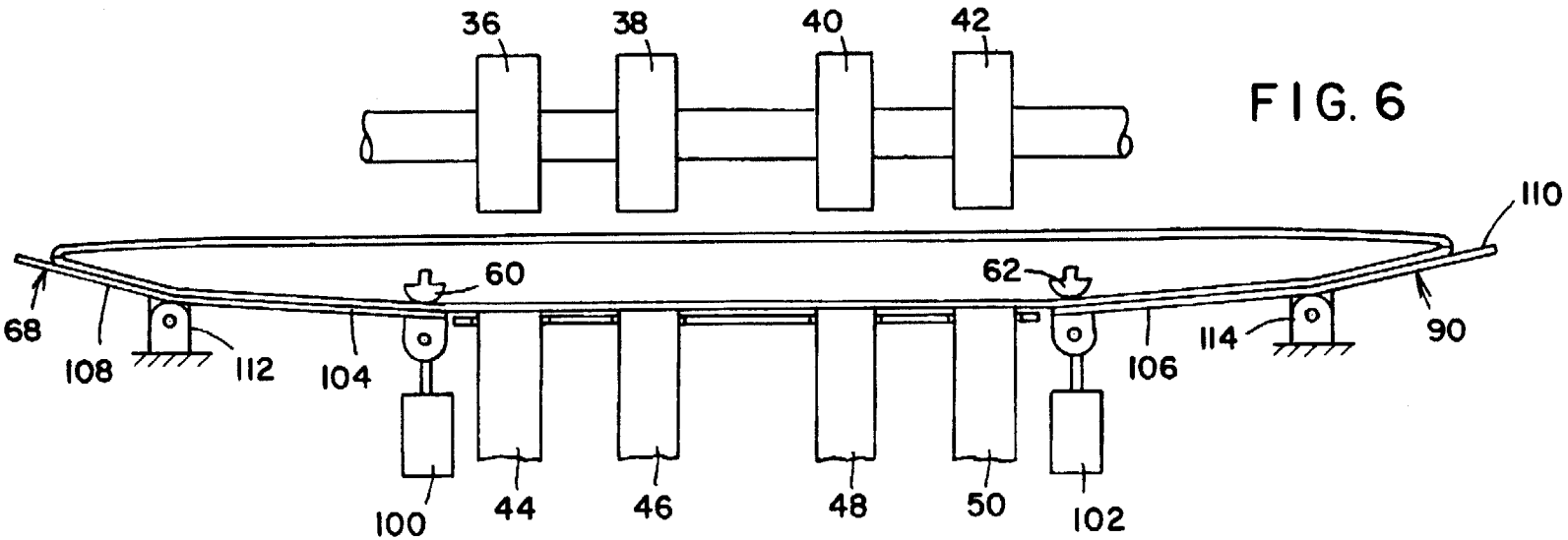
FIG. 6 is a sectional view taken on the plane indicated by the line 6—6 in FIG. 4.

Once the envelope has reached the position of the envelope **24*a*, the flapper paddles 68 and 70 are rotated by a pair of solenoids 100 and 102 respectively to the positions seen in FIG. 6 so that the envelope 24*a* can be puckered, i.e. the envelope front panel 118 (address bearing panel) is separated from the back panel 116 (see FIG. 4). The hold-down fingers 60 and 62 are rotated downward to the positions seen in FIGS. 4 and 6 against the flapper paddles 68 and 70 respectively, thereby forcing the flap 64 and the front panel 118 downward and puckering the envelope 24*a*** and causing it to open.

Once the envelope **24*a* has been opened as seen in FIG. 4, the enclosure documents are fed along the chute 72 to the feed rollers 36, 38, 40 and 42, which convey the enclosure documents into the waiting envelope 24*a***.

After the envelope **24*a* is filled with the documents, a pair of take-away rollers 150 and 152 engage the filled envelope 24*a* and the vertically translatable envelope stop 54 is caused to be raised (by means not shown) so that the filled envelope 24a can exit the inserting station 20. The paddles 68 and 70 and the fingers 60 and 62 return to the positions seen in FIG. 5**.

Figure 5:
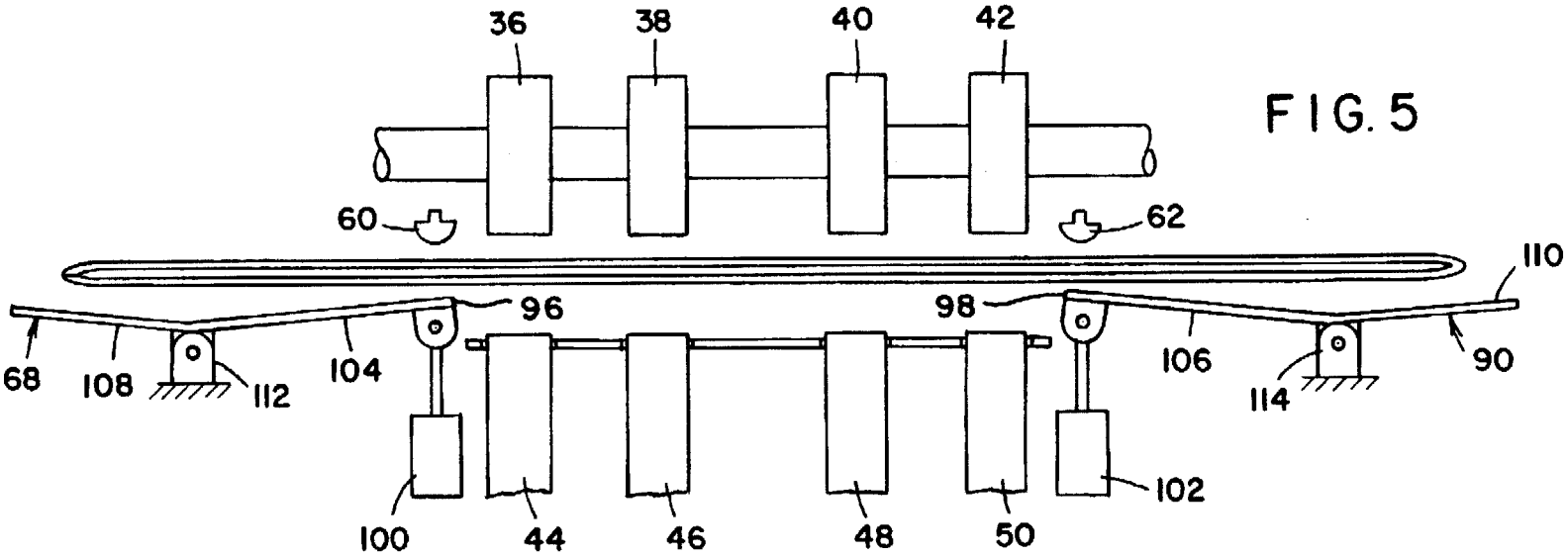
FIG. 5 is a sectional view taken on the plane indicated by the line 5—5 in FIG. 3.

As seen in FIGS. 5 and 6, the paddle supports 112 and 114 are located underneath the envelope 24a and within the outside edges of the envelope 24a. The exterior, angled legs 108 and 110 of the paddles 68 and 70 respectively have their outside edges extending beyond the outside edges of the envelope 24a, and the fingers 60 and 62 are located above the solenoids 100 and 102 respectively at the ends of the interior legs 104 and 106 respectively. Although a pair of solenoids 100 and 102 are shown as the rotating agent for the paddles 68 and 70 respectively, other rotating devices may be used, such as a cam and cam follower.

From the foregoing description, it can be seen that puckering the envelope through use of the paddles 68 and 70 and the hold-down fingers 60 and 62 respectively causes the back and front panels 116 and 118 to separate and thereby open the envelope 24a. Such an opening process is not only reliable, but functions for a variety of envelope sizes and styles.

It should be understood by those skilled in the art that various modifications may be made in the present invention without departing from the spirit and scope thereof, as described in the specification and defined in the appended claims.

What is claimed is:

1. Apparatus for opening an envelope having a front panel, a back panel and a closing flap, comprising:

means for supporting the envelope in a substantially horizontal plane wherein said beck panel is situated above said front panel;

a pair of pivotable paddles located beneath said closing flap and said front panel, each of said paddles having an interior end and an exterior end;

a pair of pivotable, hold-down fingers located above and spaced from said pivotable paddles;

means for rotating the interior ends of said paddles downward; and means for pivoting said hold-down fingers into engagement with said paddles when the ends of said paddles are rotated downward, whereby the front and back panels of said envelope are caused to separate.

2. The apparatus of claim 1, wherein each of said pivotable paddles includes an interior leg and an exterior, angled leg.

3. The apparatus of claim 2, wherein each of said legs in each of said paddles pivots about a support.

4. The apparatus of claim 3, wherein said supports are located inside the outside edge of said envelope and under said closing flap.

5. The apparatus of claim 4, wherein said rotating means comprises a solenoid for each of said pivotable paddles.

6. The apparatus of claim 5, wherein each of said exterior, angled legs forms an angle of between about 135 and 165 degrees with its respective interior leg.

* * * * *